US010594103B2

(12) United States Patent
Steinberg et al.

(10) Patent No.: US 10,594,103 B2
(45) Date of Patent: Mar. 17, 2020

(54) METHOD FOR MOISTURE PROOF COVERING A CONNECTION POINT BETWEEN AN ELECTRICAL CONDUCTOR AND A CONTACT ELEMENT

(71) Applicant: NEXANS, Paris (FR)

(72) Inventors: Helmut Steinberg, Stoernstein (DE); Thomas Noetzel, Floss (DE); Udo Mayer, Weiden (DE)

(73) Assignee: NEXANS, Courbevoie (FR)

( * ) Notice: Subject to any disclaimer, the term of this patent is extended or adjusted under 35 U.S.C. 154(b) by 272 days.

(21) Appl. No.: 13/975,417

(22) Filed: Aug. 26, 2013

(65) Prior Publication Data

US 2014/0059853 A1 Mar. 6, 2014

(30) Foreign Application Priority Data

Aug. 29, 2012 (EP) ..... 12306030

(51) Int. Cl.
*H01R 4/70* (2006.01)
*H01R 43/00* (2006.01)
*H01R 4/02* (2006.01)

(52) U.S. Cl.
CPC ..... *H01R 43/005* (2013.01); *H01R 4/70* (2013.01); *H01R 4/023* (2013.01); *Y10T 29/49171* (2015.01)

(58) Field of Classification Search
CPC .... H01R 43/005; H01R 4/70; Y10T 29/49171
USPC ..... 29/855, 879, 883, 874, 876, 856, 858, 29/859, 860, 867
See application file for complete search history.

(56) References Cited

U.S. PATENT DOCUMENTS 2,022,544 A * 11/1935 Huber ..... B60M 5/00 238/14.12
2,210,487 A * 8/1940 Kimmich ..... H01R 9/24 439/712
2,732,535 A * 1/1956 Hammerly ..... H01R 4/26 439/814
3,123,663 A * 3/1964 Muldoon ..... H01R 4/20 174/84 C
3,324,441 A * 6/1967 Olsen ..... H01R 4/20 338/332

(Continued)

*Primary Examiner* — Peter Dungba Vo
*Assistant Examiner* — Kaying Kue
(74) *Attorney, Agent, or Firm* — Sofer & Haroun, LLP

(57) ABSTRACT

A method is disclosed for moisture tight covering a connection point between an electrical conductor. The method includes exposing the conductor at its end by removing the insulation and subsequently electrically conductively connecting the end of the conductor, from which the insulation has been removed, to the contact element. After the connection point is finished, a foil of insulation material is positioned underneath the connection point, where the foil rests against the insulation of the conductor and at least partially against the contact element. Subsequently, a sealing material capable of hardening is applied from above onto the conductor, wherein the sealing material is flowable during its application and subsequently changes over by hardening into a mechanically stable state which extends beyond the insulation of the conductor and beyond the contact element and is connected tightly to the foil.

1 Claim, 1 Drawing Sheet

(56) References Cited

U.S. PATENT DOCUMENTS 4,231,041 A * 10/1980 Graeser, Jr. ..... H01Q 1/32 174/94 R
4,749,368 A * 6/1988 Mouissie ..... H01R 4/2495 439/421
4,863,535 A * 9/1989 More ..... H01R 4/70 156/49
4,945,192 A * 7/1990 Urushibata ..... H01R 12/63 174/88 R
5,025,554 A * 6/1991 Dohi ..... H01R 4/187 29/860
5,222,811 A * 6/1993 Miyoshi ..... G01K 7/16 174/94 R
5,234,515 A * 8/1993 Sekkelsten ..... H01R 4/70 156/158
5,316,789 A * 5/1994 Ookuma ..... H01R 4/70 156/185
5,456,791 A * 10/1995 Ueno ..... H01R 4/70 156/382
5,509,202 A * 4/1996 Abdow ..... H02G 15/18 156/49
5,519,170 A * 5/1996 Nabeshima ..... H01R 13/5205 174/74 R
6,350,145 B1 * 2/2002 Chen ..... H01R 4/182 439/422
7,008,273 B2 * 3/2006 Zhou ..... H01R 4/023 439/874
7,059,884 B2 * 6/2006 Hisaeda ..... H01R 13/20 439/329
7,572,979 B2 * 8/2009 Otsuki ..... H01R 13/5213 174/84 R
8,723,040 B2 * 5/2014 Sakura ..... H01R 4/185 174/68.1
9,407,051 B2 * 8/2016 Katou ..... H01R 4/70
2002/0148633 A1 * 10/2002 Kanda ..... H01R 13/5205 174/77 R
2005/0003709 A1 * 1/2005 Nagamine ..... H01R 13/5205 439/587
2008/0277607 A1 * 11/2008 Sawai ..... F16K 13/10 251/65
2010/0075522 A1 * 3/2010 Okayasu ..... H01R 4/184 439/271
2011/0070781 A1 * 3/2011 Kitagawa ..... H01R 4/185 439/877
2012/0175166 A1 * 7/2012 Ooishi ..... H01R 4/20 174/72 A
2012/0324727 A1 * 12/2012 Seifert ..... H01R 4/187 29/867
2013/0115830 A1 * 5/2013 Seifert ..... H01R 4/185 439/888

* cited by examiner

METHOD FOR MOISTURE PROOF COVERING A CONNECTION POINT BETWEEN AN ELECTRICAL CONDUCTOR AND A CONTACT ELEMENT

RELATED APPLICATION

This application claims the benefit of priority from European Patent Application. No. 12 306 030.3, filed on Aug. 29, 2012, the entirety of which is incorporated by reference.

BACKGROUND

Field of the Invention

The invention relates to a method for moisture proof covering a connection point between an electrical conductor composed of individual wires and surrounded by insulation, and a contact element of metal, wherein the conductor is initially exposed at its end by removing the insulation, wherein subsequently the end of the conductor whose insulation has been removed is electrically conductively connected in the connection point to the contact element, and wherein finally a cover consisting of insulation material is placed onto the connecting point between conductor and contact element.

Description of Related Art

Such a method has been generally known for years. It is used in all those cases where an electrical contact point is to be protected against moisture. The flexible conductor's consisting of individual wires are referred to in the following as "strand." In particular, copper and aluminum, as well as alloys of these materials, are used as electrically conductive material of such strands. A field of use for the strands is, for example, the engine compartment of motor vehicles. In this case, moisture and other environmental influences as well as vibrations, must additionally be taken into consideration with respect to the sealing of the connection point between strands and contact elements. In known methods, a protective body consisting of insulation material is injection molded in an injection molding tool around a connection point. In another known method, a hose consisting of shrinkable material, which is coated on the inside with sealing material, is pushed over a connection point, wherein the hose rests tightly against its support after heating. Both methods are not only complicated, but they can also not ensure the necessary sealing action because neither the injection molding material of the protective body, nor the sealing material of the hose penetrate sufficiently deeply between the individual wires of the strand. A gap existing between the conductor and its insulation is in both methods also not sealed, so that moisture which has penetrated into the connection point can also penetrate in the longitudinal direction of the conductor. It can then cause a short circuit at the far end of the conductor and may lead to corrosion in the connection point which can quickly destroy the connection point.

OBJECTS AND SUMMARY

The invention is based on the object of further developing the above described method in such a way that an effective sealing action of the connection point against moisture can be achieved between strand and contact element.

In accordance with the invention, this object is met in that, after the connection point has been finished, a foil of insulation material is positioned underneath the connection point, wherein the insulation foil, adheres, at least partially, to the contact element, and that, subsequently, a sealing material capable of hardening is applied from above onto the strand, wherein the sealing material is flowable when being applied and subsequently changes over into a mechanically stable state by hardening, and wherein the contact element extends beyond the insulation of the strand and is tightly connected to the foil.

In this method, a sufficient quantity of an initially flowable sealing material is applied onto the connection point between strand and contact element, particularly onto the strand, wherein the sealing material penetrates into the strand because of its viscosity. The sealing material is applied in such a quantity that it extends past the insulation of the strand, so that the gap between strand and insulation is also closed by the sealing material. The sealing material penetrates, at least over a short distance, into the gap between the strand and the insulation surrounding the strand. This is facilitated or completed by the foil arranged underneath the connection point and resting against the insulation of the strand and against the contact element, wherein the foil serves as a border for the sealing material. It is connected tightly to the sealing material, so that a sealing body is obtained which is closed circumferentially around the connection point and is stable after hardening of the sealing material. The sealing body seals the connection point effectively overall, against moisture.

A spatially limited spacer member can be mounted between the contact element and the foil. The sealing material then also adheres from below to the contact element.

BRIEF DESCRIPTION OF THE DRAWINGS

The method according to the invention will be explained with the aid of an embodiment illustrated in the drawings.

In the drawing.

DETAILED DESCRIPTION

Figure 1:
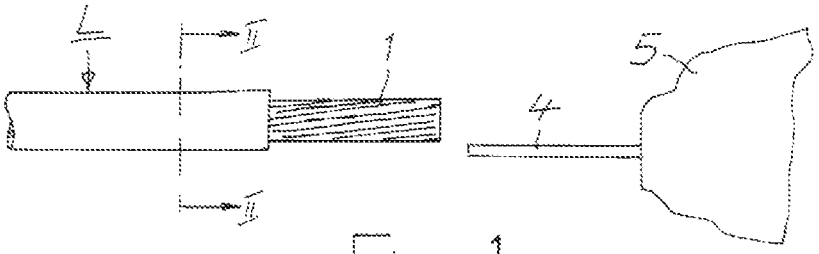
FIG. 1 is an elevation view of an electrical line with a conductor constructed as a strand and a contact element, shown separated from each other.
Figure 2:
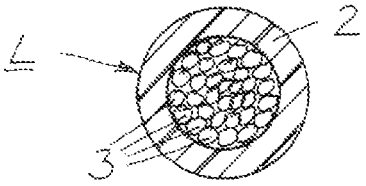
FIG. 2 is a sectional view taken along sectional line II-II of FIG. 1, on a larger scale.

FIG. 1 shows an electrical line L which is composed of a strand 1 and an insulation 2 surrounding the strand. In accordance with FIG. 2, the strand 1 is constructed with a plurality of individual wires 3 which are preferably stranded or twisted together. The individual wires 3 may be, for example of copper or of aluminum or of a copper alloy or an aluminum alloy. The insulation 2 may be composed for example of polyethylene or polyurethane. In accordance with FIG. 1, the insulation is removed at the end of the line L, so that the strand 1 is exposed at this location and can be used for directly connecting to electrical contacts or from electrical contacts.

Figure 3:
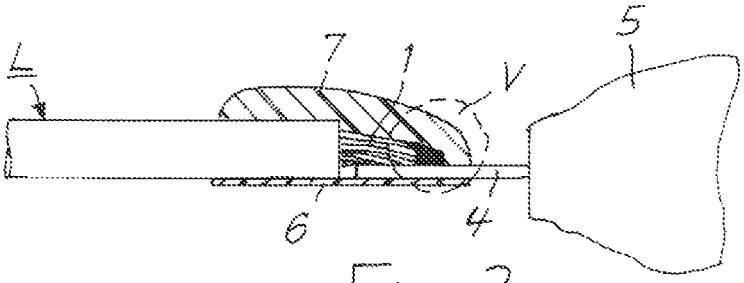
FIG. 3 shows a sectional view taken through a connection point between the strand and the contact element according to FIG. 1, in a schematic illustration.

In the present case, the strand 1 is electrically conductively connected to a contact element 4 of metal which is part of an electrical device 5 which is only shown schematically. The contact element 4 may be for example, a flat strip with a rectangular cross section. However, it may also have a different geometric shape. The strand 5 is advantageously combined and advantageously compacted at its free end in such a way that no individual wires 3 project laterally therefrom. Subsequently, the strand 1 is electrically conductively connected to the contact element 4, for example, by soldering, or advantageously by welding. Compacting and soldering or welding of the strand 1 to the contact element 4 can also be carried out in only one work step. A connection point V resulting from this treatment is shown schematically in FIG. 3 surrounded by a broken line. For example, such a connection point V is covered in a moisture proof manner by means of the method according to the invention as follows:

Initially, a foil 6 of insulation material is placed from below against the connection point V or the connection point V is placed on the foil 6. In both cases, the foil 6 rests against the insulation 2 of the line L as well as to the contact element 4. Advantageously, it projects on all sides beyond the actual connection point V between strand 1 and contact element 4. Suitable materials for the foil 6 are, for example, polyethylene terephthalate, polyurethane, polyvinylchloride, polyamide and polyethylene.

Subsequently, an initially flowable sealing material is placed from above onto the connection point V, preferably directly onto the strand 1. This can be carried out by casting or by drops or also by using a type of syringe. Suitable sealing materials are polyvinylchloride, polyurethane, polyamide, silicon rubber as well as fluoroethylenepropylene and perfluoroalkoxy polymer. It may consist of only one material, or it may be a material composed of two different components. The flowable sealing material penetrates between the individual wires 3 of the strand 1. The foil 6 catches the sealing material as the material moves downwardly, so that the material can only spread out in the connection point V itself and around the connection point V. The sealing material also penetrates over a short distance into the circumferential gap existing between strand 1 and insulation 2 of the line L, which closes the gap. The sealing material finally extends on one side beyond the insulation 2 of the line L, and on the other side beyond the contact element 4. After being applied, the sealing material hardens relatively quickly, so that a mechanically stable sealing member 7 is obtained which seals the connection point V effectively against moisture.

Figure 4:
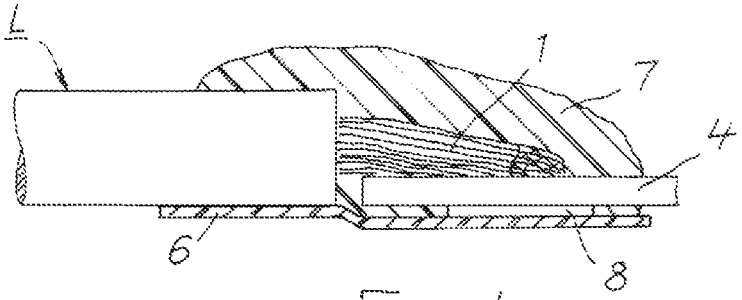
FIG. 4 shows a detail of FIG. 3 on a larger scale.

In accordance with FIG. 4, a spacer member 8 may be arranged between the foil 6 and the contact element 4 before the sealing material is applied. The spacer member 8 has a smaller surface as compared to the surface of the contact element 4. If the spacer member 8 is used, the sealing material can also spread out between the contact element 4 and the foil 6, so that the contact element 4 is almost completely surrounded by sealing material in the area of the connection point 4. For example, the spacer member 8 which consists of any chosen material may be constructed as a disk, or may consist of ribs which, prior to mounting the foil 6, are arranged or fastened to the insulation 2 of the conductor 1 and to the contact element 4.

No expensive tools or molding equipment are required for carrying out the method because the sealing material can be applied onto the connection point V without limiting structural components—with the exception of the foil 6—onto the connection point V.

The invention claimed is:

1. Method for moisture proof covering a connection point between an electrical conductor, which comprises individual wires and which is surrounded by an insulation, and a contact element of metal in a form of a flat strip with a rectangular cross section, said method comprising the step of:

the wires of the conductor are initially exposed at an end of said conductor by removing the insulation, the wires then being compacted together at a distal end of the conductor;

subsequently the wires from which the insulation has been removed is electrically conductively connected to the contact element in the form of the flat strip with the rectangular cross section in the connection point by soldering or welding, the contact element remaining in said form of the flat strip with the rectangular cross section;

finally the connection point between the wires and the contact element is covered by following steps including, wherein after finishing the connection point, a foil of insulation material is positioned underneath the contact element which rests against the insulation of the conductor and at least partially against the contact element, a spacer member is placed between the foil and the contact element, where the spacer member constructed as at least one of a disk and ribs with a surface area which is smaller than the surface area of the contact element in the form of the flat strip, and wherein subsequently, sealing material which is capable of hardening is applied from above onto the connection point between the conductor and the contact element, where the sealing material is flowable when applied and then changes over into a mechanically stable state as a result of hardening, and where the sealing material spreads between the contact element and the foil, and extends beyond the insulation of the conductor and beyond the contact element in the form of the flat strip and is fixedly connected to the foil so that a gap between the conductor and its insulation is closed by the sealing material.

* * * * *